US012049820B2

(12) United States Patent
Mahmoud Aly et al.

(10) Patent No.: US 12,049,820 B2
(45) Date of Patent: Jul. 30, 2024

(54) ESTIMATED ULTIMATE RECOVERY FORECASTING IN UNCONVENTIONAL RESERVOIRS BASED ON FLOW CAPACITY

(71) Applicant: Saudi Arabian Oil Company, Dhahran (SA)

(72) Inventors: Ihab S. Mahmoud Aly, Dhahran (SA); Mustafa A. Basri, Dhahran (SA); Cenk Temizel, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 114 days.

(21) Appl. No.: 17/328,735

(22) Filed: May 24, 2021

(65) Prior Publication Data

US 2022/0372873 A1 Nov. 24, 2022

(51) Int. Cl.

| | |
|---|---|
| ***E21B 43/26*** | (2006.01) |
| ***E21B 47/10*** | (2012.01) |
| ***E21B 49/08*** | (2006.01) |
| *E21B 49/00* | (2006.01) |

(52) U.S. Cl.

CPC ..... *E21B 49/0875* (2020.05); *E21B 47/10* (2013.01); *E21B 43/26* (2013.01); *E21B 49/00* (2013.01)

(58) Field of Classification Search

CPC ..... E21B 49/0875; E21B 43/26; E21B 49/00
USPC ..... 166/250.1
See application file for complete search history.

(56) References Cited

U.S. PATENT DOCUMENTS

| | | | |
|---|---|---|---|
| 9,187,984 | B2 | 11/2015 | Usadi et al. |
| 9,710,766 | B2 | 7/2017 | Saleri et al. |
| 9,778,627 | B2 | 10/2017 | Stoettrup et al. |
| 9,901,868 | B2 | 2/2018 | Salu et al. |
| 9,910,938 | B2 | 3/2018 | Morales German et al. |

(Continued)

FOREIGN PATENT DOCUMENTS

| | | |
|---|---|---|
| WO | WO 2019217131 | 11/2019 |
| WO | WO 2020040829 | 2/2020 |
| WO | WO 2020112141 | 6/2020 |

OTHER PUBLICATIONS

Anderson et al., "Petroleum Analytics Learning Machine to Forecast Production in the Wet Gas Marcellus Shale," URTeC 2426612, Unconventional Resources Technology Conference (URTeC), Fueled by SPE, AAPG, SEG, presented at the Unconventional Resources Technology Conference in San Antonio, Texas, USA, Aug. 1-3, 2016, 17 pages.

(Continued)

*Primary Examiner* — Zakiya W Bates
*Assistant Examiner* — Ashish K Varma
(74) *Attorney, Agent, or Firm* — Fish & Richardson P.C.

(57) ABSTRACT

Embodiments herein relate to a technique that may include identifying historical data related to at least one remote well. The technique may further include identifying, based on the historical data, a correlation between gas flow capacity and estimated ultimate recovery (EUR) of the at least one other well. The technique may further include identifying gas flow capacity of a well. The technique may further include predicting, based on the gas flow capacity of the well and the identified correlation between gas flow capacity and EUR of the at least one other well, EUR of the well. The technique may further include operating the well based on the predicted EUR. Other embodiments may be described or claimed.

15 Claims, 15 Drawing Sheets

(56) References Cited

U.S. PATENT DOCUMENTS

| | | | | |
|---|---|---|---|---|
| 9,934,295 | B2 | 4/2018 | Sarferaz | |
| 9,940,414 | B2 | 4/2018 | Ortiz et al. | |
| 9,946,974 | B2 | 4/2018 | Burch et al. | |
| 9,957,783 | B2 | 5/2018 | Gonzales et al. | |
| 9,994,118 | B2 | 6/2018 | Williams et al. | |
| 10,012,056 | B1 | 7/2018 | LaPierre | |
| 10,012,748 | B2 | 7/2018 | Gupta | |
| 10,079,317 | B2 | 9/2018 | Gonatas | |
| 10,087,722 | B2 | 10/2018 | Lecerf et al. | |
| 10,175,360 | B2 | 1/2019 | Zweigle et al. | |
| 10,240,098 | B2 | 3/2019 | Randhava et al. | |
| 10,254,432 | B2 | 4/2019 | Cuevas et al. | |
| 10,267,132 | B2 | 4/2019 | Hoeink | |
| 10,288,041 | B2 | 5/2019 | Williams | |
| 10,301,918 | B2 | 5/2019 | Weng et al. | |
| 10,324,230 | B2 | 6/2019 | Kuchuk et al. | |
| 10,355,486 | B2 | 7/2019 | Pflaum et al. | |
| 10,360,783 | B2 | 7/2019 | Maher et al. | |
| 10,378,324 | B2 | 8/2019 | Conn et al. | |
| 10,378,344 | B2 | 8/2019 | Al-Dosary et al. | |
| 10,380,524 | B1 | 8/2019 | Raymond | |
| 10,409,925 | B1 | 9/2019 | Hoff | |
| 10,415,354 | B2 | 9/2019 | Chidiac et al. | |
| 10,418,595 | B2 | 9/2019 | Li | |
| 10,436,940 | B2 | 10/2019 | Maucec et al. | |
| 10,443,359 | B2 | 10/2019 | DeValve et al. | |
| 10,445,669 | B2 | 10/2019 | Wessling et al. | |
| 10,450,841 | B2 * | 10/2019 | Fulford | G06G 7/57 |
| 10,495,589 | B2 | 12/2019 | Tae Kwak et al. | |
| 10,508,520 | B2 | 12/2019 | Saleri et al. | |
| 10,508,532 | B1 | 12/2019 | Mondal et al. | |
| 10,519,759 | B2 | 12/2019 | Klie | |
| 10,526,890 | B2 | 1/2020 | Batmaz et al. | |
| 10,534,961 | B2 | 1/2020 | Rostand et al. | |
| 10,541,374 | B2 | 1/2020 | Li | |
| 10,563,493 | B2 | 2/2020 | Ganguly et al. | |
| 10,599,747 | B1 | 3/2020 | Hoff | |
| 10,614,414 | B1 | 4/2020 | Raymond | |
| 10,634,815 | B1 | 4/2020 | LaPierre | |
| 10,655,442 | B2 | 5/2020 | Lecerf et al. | |
| 10,665,796 | B2 | 5/2020 | Li | |
| 10,670,753 | B2 | 6/2020 | de Matos Ravanelli et al. | |
| 10,718,208 | B2 | 7/2020 | Chorn | |
| 10,738,599 | B2 * | 8/2020 | Babin | G06F 30/20 |
| 10,740,512 | B2 | 8/2020 | Hoff | |
| 10,760,416 | B2 | 9/2020 | Weng et al. | |
| 10,788,604 | B2 | 9/2020 | Garcia-Teijeiro et al. | |
| 10,804,702 | B2 | 10/2020 | Claessens et al. | |
| 2007/0179767 | A1 | 8/2007 | Cullick et al. | |
| 2008/0210470 | A1 * | 9/2008 | Stewart | E21B 47/06 175/48 |
| 2010/0198570 | A1 | 8/2010 | Sarma et al. | |
| 2013/0096899 | A1 | 4/2013 | Usadi et al. | |
| 2017/0145793 | A1 | 5/2017 | Ounes | |
| 2018/0066501 | A1 * | 3/2018 | Chidiac | G06F 30/20 |
| 2019/0249534 | A1 | 8/2019 | Hoeink et al. | |
| 2021/0124087 | A1 * | 4/2021 | Liu | E21B 49/087 |

OTHER PUBLICATIONS

Anderson et al., "Probabilistic Forecasting of Unconventional Resources Using Rate Transient Analysis: Case Studies," SPE 155737, Society of Petroleum Engineers (SPE), presented at the Americas Unconventional Resources held in Pittsburgh, Pennsylvania, USA, Jun. 5-7, 2012, 16 pages.

Asquith, "Reservoir Producibility Index (RPI) from NMR Logs and the Analysis of Tight Oil Reservoirs," URTeC 2673849, Unconventional Resources Technology Conference (URTeC), Fueled by SPE, AAPG, SEG, presented at the Unconventional Resources Technology Conference in Austin, Teas, Jul. 24-26, 2017, 5 pages.

Cao et al., "Data Driven Production Forecasting Using Machine Learning," SPE 180984-MS, Society of Petroleum Engineers (SPE), presented at the SPE Argentina Exploration and Production of Unconventional Resources Symposium held in Buenos Aires, Argentina, Jun. 1, 2016, 10 pages.

Chen et al., "Prediction of Sweet Spots in Shale Reservoir Based on Geophysical Well Logging and 3D Seismic Data, " Energy Exploration and Exploitation, Mar. 2017, 35:2 (147-171), 26 pages.

Clarkson and Williams-Kovacs, "Modeling Two-Phase Flowback of Multifractured Horizontal Wells Completed in Shale," SPE 162593, Society of Petroleum Engineers (SPE), presented at the SPE Canada Unconventional Resources Conference, Calgary, Oct. 30-Nov. 1, 2012, 18 pages.

ihsenergy.ca [online], "Harmony Enterprise Software, Feb. 2020," retrieved from URL <https://www.ihsenergy.ca/support/documentation_ca/Harmony_Enterprise/2020_2/content/html_files/start_here.htm>, Oct. 13, 2020, 2 pages.

Jiang et al., "Evaluating Producible Hydrocarbons and Reservoir Quality in Organic Shae Reservoirs using Nuclear Resonance (NMR) Factor analysis," SPE 175893-MS, Society of Petroleum Engineers (SPE), presented at the SPE/CSUR Unconventional Resources Conference in Calgary, Alberta, Canada, Oct. 20-22, 2015, 9 pages.

Kausik et al., "Novel Reservoir Quality Indices for Tight Oil," SPE 178622-MS, URTeC 2154859, Society of Petroleum Engineers (SPE), Unconventional Resources Technology Conference (URTeC), Fueled by SPE, AAPG, SEG, presented at the Unconventional Resources Technology Conference in San Antonio, Texas, US, Jul. 20-22, 2015, 10 pages.

Mahmoud et al., "Practical Application of Type Curve Analysis to the Interpretation of Multi-Stage Fractured Horizontal Well Data," SPE-175931, Society of Petroleum Engineers (SPE), presented at the SPE/CSUR Unconventional Resources Conference held in Calgary, Alberta, Canada, 2015, 12 pages.

Patzek et al., "Gas production in the Barnett shale obeys a simple scaling theory," PNAS, Dec. 2013, 110:49 (19731-19736), 6 pages.

Ter Heege et al., "Sweet Spot Identification in Underexplored Shales Using Multidisciplinary Reservoir Characterization and Key Performance Indicators: Example of the Posidonia Shale Formation in he Netherlands," Journal of Natural Gas Science and Engineering, 2015, 27: 558-577, 20 pages.

WikiStat, "Neural networks and introduction to deep learning," 2017, retrieved from URL <https://www.math.univ-toulouse.fr/~besse/Wikistat/pdf/st-m-hdstat-rnn-deep-learning.pdf>, 17 pages.

* cited by examiner

800

1500

ESTIMATED ULTIMATE RECOVERY FORECASTING IN UNCONVENTIONAL RESERVOIRS BASED ON FLOW CAPACITY

TECHNICAL FIELD

The present disclosure applies to forecasting of estimated ultimate recovery (EUR) of a well based on flow capacity.

BACKGROUND

EUR forecasting is a challenging task for wells in unconventional shale reservoirs. Legacy techniques typically may not be ideal in these types of wells where very tight rock in the order of nano-Darcy is exploited through long multi-fractured horizontal wells. Specifically, the legacy techniques may not be ideal where desired productivity is achieved by hydraulic fracturing and most of the resultant drainage occurs in the stimulated reservoir volume (SRV). Inappropriate forecasting may result in undesirable use of resources to drill or operate these wells.

SUMMARY

The present disclosure describes techniques that can be used for forecasting EUR for wells completed in tight/shale reservoirs from short flowback data. Specifically, in embodiments, flow capacity (e.g., gas flow capacity and/or water flow capacity) may be used as a parameter that captures and reflects the major drainage mechanism and recovery characteristics of the well within the unconventional reservoir. Thus, the flow capacity may serve as a reference parameter that can be estimated from early-time data. This parameter may have the ability to reflect the future production behavior of the well in terms of cumulative production through proportional comparison of flow capacity to EUR.

In some implementations, a computer-implemented method includes identifying historical data related to at least one remote well. The method further includes identifying, based on the historical data, a correlation between gas flow capacity and estimated ultimate recovery (EUR) of the at least one other well. The method further includes identifying gas flow capacity of a well. The method further includes predicting, based on the gas flow capacity of the well and the identified correlation between gas flow capacity and EUR of the at least one other well, EUR of the well. The method further includes operating the well based on the predicted EUR.

In another implementation, a computer-implemented method includes identifying data related to gas flow capacity of gas in a well. The method further includes predicting, based on the data related to the gas flow capacity, an estimated ultimate recovery (EUR) of the well. The method further includes operating the well based on the predicted EUR of the well.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize various advantages. For example, embodiments may allow for the incorporation of analysis of several existing wells to create a single correlation that describes the relationship between gas flow capacity of the well and EUR. As such, it may be possible to evaluate EUR of a well from as early as one to two weeks of flowback data. The early evaluation of these wells may expedite critical completion and development decisions that impact project economics. For example, the early evaluation may impact decisions such as number of development wells, spacing between development wells, development wells placement and fracturing job design; including fracture fluid type and volume, proppant type and amount, number of fracture clusters and stages based on the EUR, etc.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for forecasting EUR based on flow capacity of a well.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

As previously noted, it may be difficult to evaluate EUR and production forecasting in multi-fracture horizontal well completed in unconventional shale reservoirs. Particularly, it may be difficult to perform this evaluation during the early exploration and appraisal stages of field lifecycle. With the absence of suitable production facilities to handle fluids produced by early wells operations, wells are opened to flare for short period of flow back (2-6 weeks) for completion fluid recovery (cleanup) and quick performance evaluation. Only few key wells, connected to the temporary early production facilities (EPF), are opened for extended production time for more extensive performance evaluation.

Embodiments herein relate to a workflow to estimate EUR for such wells based on a relatively small amount of flowback data. Specifically, embodiments relate to a correlation between gas flow capacity ($Ac\sqrt{k}$) estimated during early stages of gas flowback (e.g., during the first 3-4 weeks of gas flowback) and EUR. Embodiments further relate to a correlation between water flow capacity estimated during early stages of water flowback (e.g., during the first 1-2 weeks of water flowback) and gas flow capacity or EUR. These correlations may be used to evaluate new wells using data during early flowback and before connecting them to a production facility.

Figure 1:
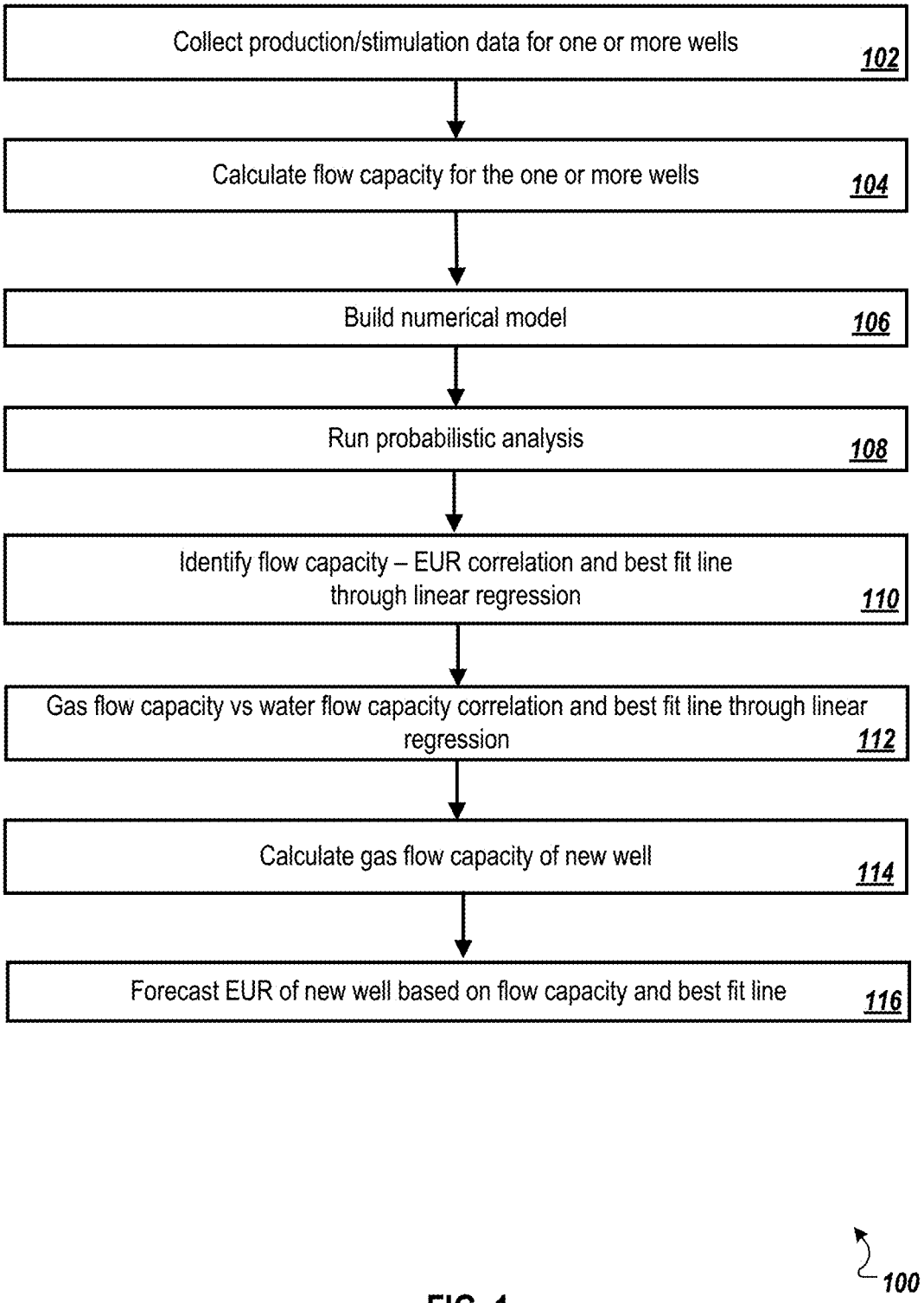
FIG. 1 depicts an example technique for the generation and use of a model that correlates flow capacity to EUR of a well, in accordance with various embodiments.

FIG. 1 depicts an example technique 100 for the generation and use of a model that correlates flow capacity to EUR of a well, in accordance with various embodiments.

Initially, the technique includes collecting, at 102, production and stimulation data for one or more previously drilled wells. The one or more previously drilled wells may be wells that include characteristics that are similar to the well under analysis. For example, the previously drilled wells may be in a same general area as the well that is under analysis. Additionally or alternatively, the previously drilled wells may be wells that are not in the same general area, but are located in similar geological formations (e.g., the same type of rock, rock with similar porosity values, etc.) Based on the production data, the flow capacity for the one or more wells may then be calculated at 104.

Figure 2:
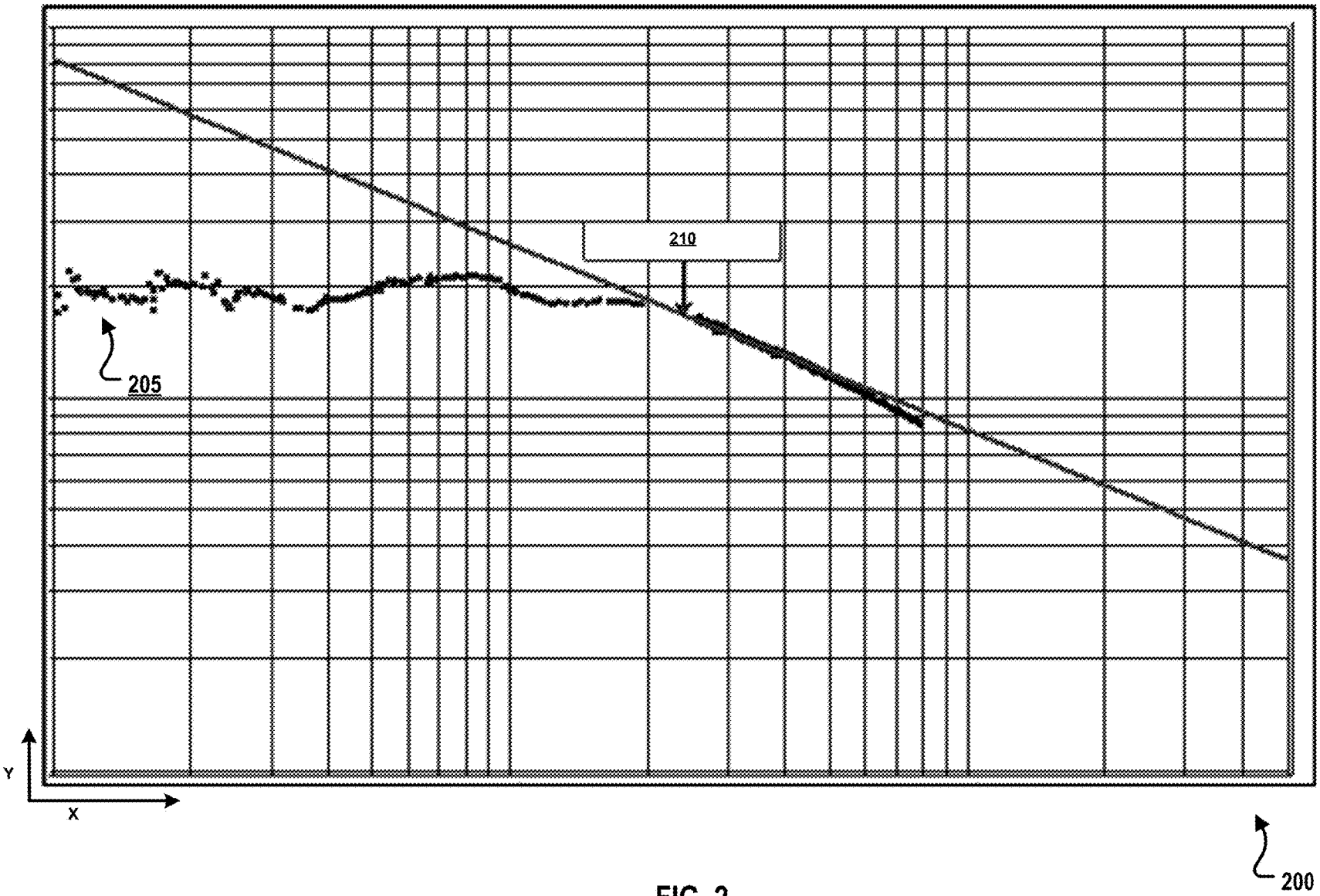
FIG. 2 depicts an example log-log plot of gas normalized rate versus gas material balance time, in accordance with various embodiments.
Figure 3:
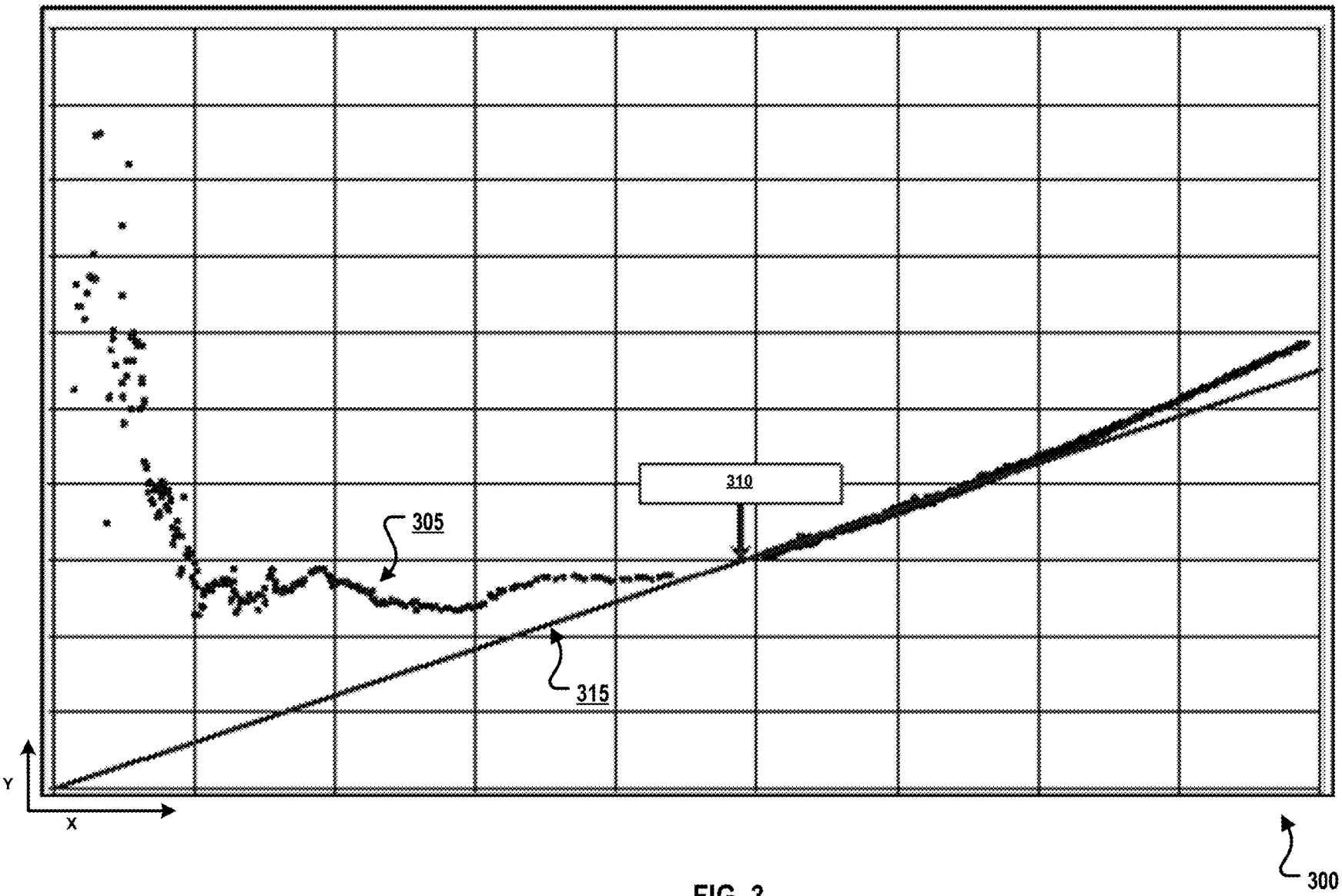
FIG. 3 depicts an example plot of gas normalized pressure versus the square root of gas material balance time, in accordance with various embodiments.

FIGS. 2-3 depict examples of data related to the previously drilled wells which may be used to calculate the flow capacity for the one or more wells as described with respect to element 104. The analysis in one or more of FIGS. 2-3 may be performed, for example, for each of the one or more wells identified at 102.

Specifically, FIG. 2 depicts an example log-log plot 200 of gas normalized rate versus gas material balance time, in accordance with various embodiments. The Y axis depicts normalized gas rate, and the X-axis depicts gas material balance time. It will be noted that the plot is a logarithmic plot. In embodiments, the plot 200 may be used to identify gas flow regimes. After initial well cleanup, the flow regime for a multi-fracture horizontal well completed in an unconventional shale reservoir is expected to be a linear flow. The data points at 205 depict the normalized gas rate over time, and then the point at 210 depicts the start of linear flow. In plot 200, the linear flow regime may be identified by a negative 1/2 slope line in the log-log plot.

FIG. 3 depicts an example plot 300 of gas normalized pressure versus the square root of gas material balance time, in accordance with various embodiments. Specifically, FIG. 3 depicts a plot of gas normalized pressure along the Y axis versus the square root of gas material balance time along the X axis. Similarly to FIG. 2, the data points 305 depict the normalized gas pressure, which become linear at 310. The slope 315 of the linear portion of the data yields gas flow capacity $Ac\sqrt{k}$ In the embodiment of FIG. 3, $$Ac\sqrt{k} = \frac{630.8T}{m} * \frac{1}{\sqrt{(\phi\mu_g C_t)_i}}$$

where m may represent the slope of the square root-time plot, T may represent the temperature of the reservoir, $\emptyset$ may represent the porosity of the reservoir, $\mu_g$ may represent the viscosity of the gas, and $C_t$ may represent the total compressibility of the gas. More generally, Ac may represent the area of flow of the material (either water or gas), and k may represent the permeability value of the material.

Figure 4:
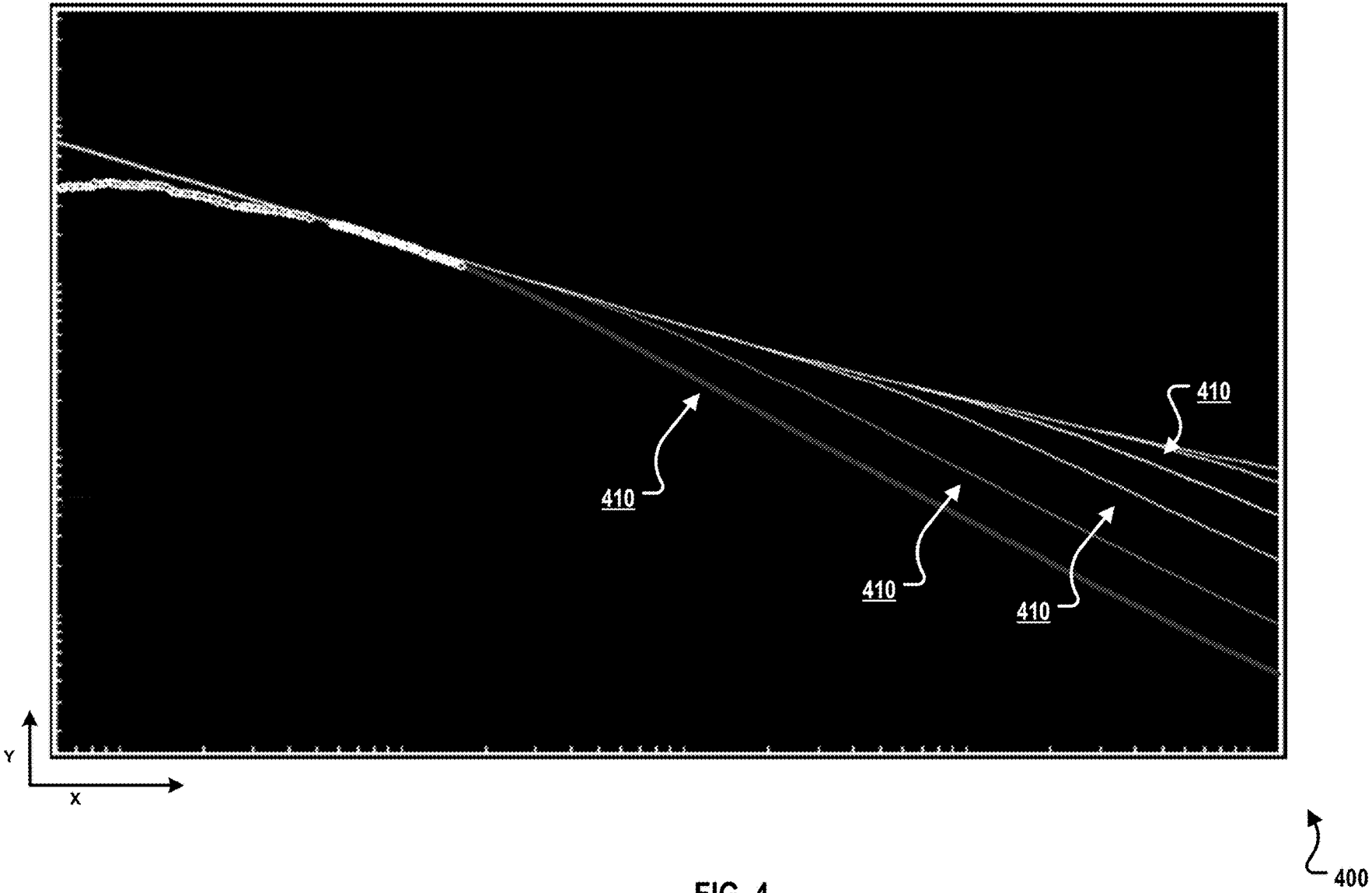
FIG. 4 depicts an example compound linear flow type curve, in accordance with various embodiments.
Figure 5:
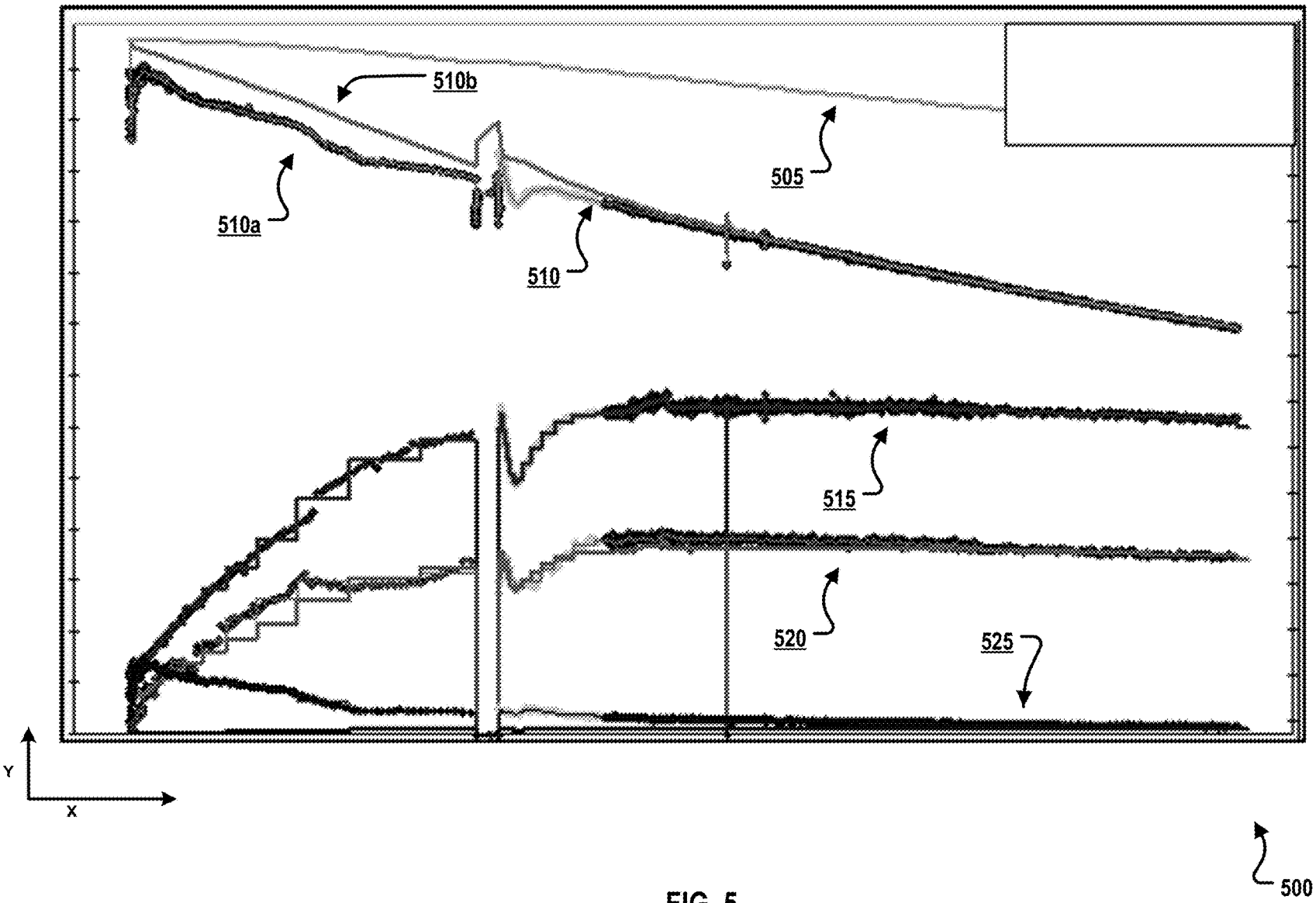
FIG. 5 depicts an example numerical model history-match, in accordance with various embodiments.
Figure 6:
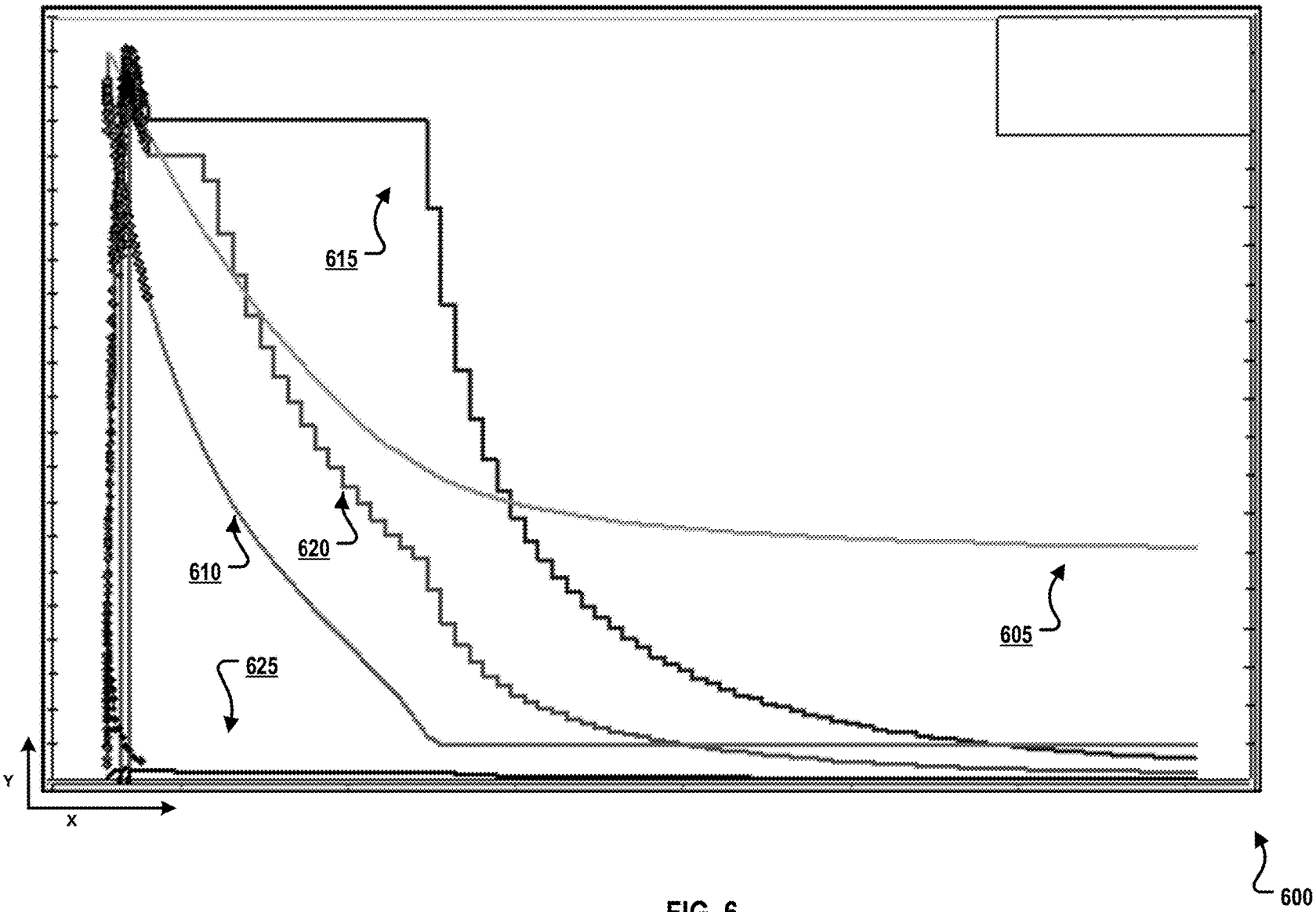
FIG. 6 depicts an example numerical model forecast, in accordance with various embodiments.

Returning to FIG. 1, the technique 100 may further include building a numerical model at 106. FIGS. 4-6 depict examples of how such a numerical model may be generated.

FIG. 4 depicts an example compound linear flow type curve 400, in accordance with various embodiments. In FIG. 4, the Y axis represents the normalized gas rate, while the X axis represents the material balance time. It will be noted that both the X and Y axes are depicted on a logarithmic scale.

Generally, the compound linear flow type curve may be used to get estimates for fracture parameters such as the fracture half-length ($x_f$), the SRV permeability ($k_{SRV}$) and the width of the stimulated zone ($x_i$). These parameters may be seeded to a deterministic model, as described below, to match historical data and create a forecast of the EUR. It will be noted, that the forecasted solution may be considered to be non-unique, as the historical data may match on several lines such as lines 410.

FIG. 5 depicts an example numerical model history match 500, in accordance with various embodiments. Specifically, the model 500 may be generated using one or more of reservoir input data, pressure-volume-time (PVT) data, and the fracture parameters described above with reference to FIG. 4. Specifically, the fracture parameters may be used as initial parameters that are then iterated upon to achieve a match to historical data. The Y axis of the model 500 relates to gas, condensate, and water flow rates and pressure, and the X axis of the model 500 relates to time.

As can be seen in FIG. 5, the model 500 may depict both historical data and synthesized data that is matched to the historical data based on the parameter iteration. For example, line 510 relates to well bottom-hole flowing pressure. The bottom-hole flowing pressure 510 may depict historical data at 510*a*, and synthesized data 510*b* that is based on the above-described parameters. As noted, the parameters upon which the synthesized data 510*b* is based are iterated until the synthesized data 510*b* generally aligns with the historical data 510*a* as shown in the model 510. The model 500 may further depict gas flow rate at 515, condensate flow rate at 520, water flow rate at 525, and synthesized reservoir pressure at 505. It will be noted that the various other depicts at 515, 520, and 525 include both depictions of both synthesized and historical data, however such data is not separately enumerated for the sake of clarity of the Figure.

FIG. 6 depicts an example numerical model forecast 600, in accordance with various embodiments. Specifically, once model 500 is generated and the match of the synthesized parameters to the historical data is performed, the model 500 of FIG. 5 may be used to forecast future parameters as shown in the model 600 of FIG. 6. In embodiments, the model 600 may be constrained by various parameters of the well upon which the parameters are based. Such parameters may include, for example, a maximum gas rate of the well, a minimum bottom hole flowing pressure, an abandonment rate, or some other parameter. Various of the parameters described with respect to the model 500 may then be forecast in model 600. For example, model 600 depicts a forecasted gas flow rate 615, a forecasted condensate flow rate 620, a forecasted water flow rate 625, a forecasted bottom-hole flowing pressure 610, and a forecasted reservoir pressure 605, which may respectively correspond to element 515, 520, 525, 510, and 505 of model 500.

Figure 7:
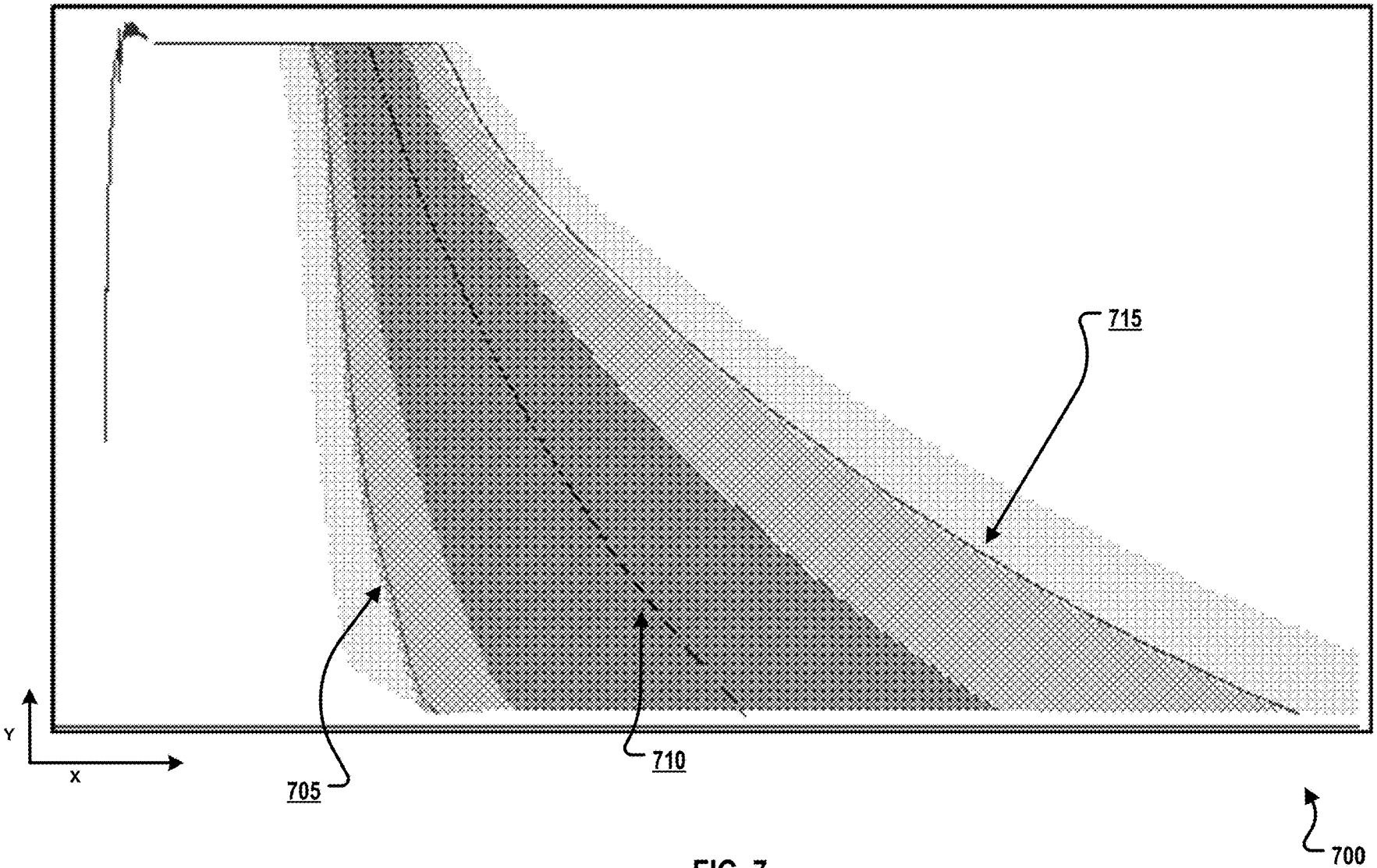
FIG. 7 depicts an example probabilistic analysis results, in accordance with various embodiments.

Returning to FIG. 1, the technique 100 then includes running, at 108, a probabilistic analysis. FIG. 7 depicts an example probabilistic analysis 700, in accordance with various embodiments. Specifically, in FIG. 7, the Y axis depicts gas flow rate, while the X axis depicts time. One example of such a probabilistic analysis is a Monte Carlo simulation. A Monte Carlo simulation may be considered to be a simulation that performs a function based on a number of parameters that are varied to provide a given outcome. The function is re-run multiple times while the parameters are varied, and then the outcomes provide a probability distribution.

For the analysis 700 of FIG. 7, for each individual well uncertainties in reservoir and fracture parameters are assessed to estimate the possible range of EUR. Such parameters may include the fracture half-length ($x_f$), the number of effective fractures ($n_f$), the fracture height ($h_f$), reservoir porosity (ø), and initial water saturation ($S_{wi}$). Additional or alternative parameters may include dimensionless fracture conductivity ($F_{CD}$), SRV permeability ($k_{SRV}$), matrix permeability ($k_{matrix}$), and width of stimulated zone ($x_i$).

The variance of the factors may provide a depicted analysis such as analysis 700. The analysis 700 may depict different percentile lines for the EUR and production forecast profiles such as a P90 line (which indicates that 90% of results will be more than the depicted line) 705, a P50 line (which indicates that 50% of the results will be more than the depicted line) 710, and a P10 zone (which indicates that 10% of the results will be more than the depicted line) 715.

The technique 100 may then include identifying, at 110, a correlation between gas flow capacity and EUR, and a best fit line through linear regression. The correlation may be based on a number of other identified correlations as described with respect to FIGS. 8 and 9, as discussed below.

Figure 8:
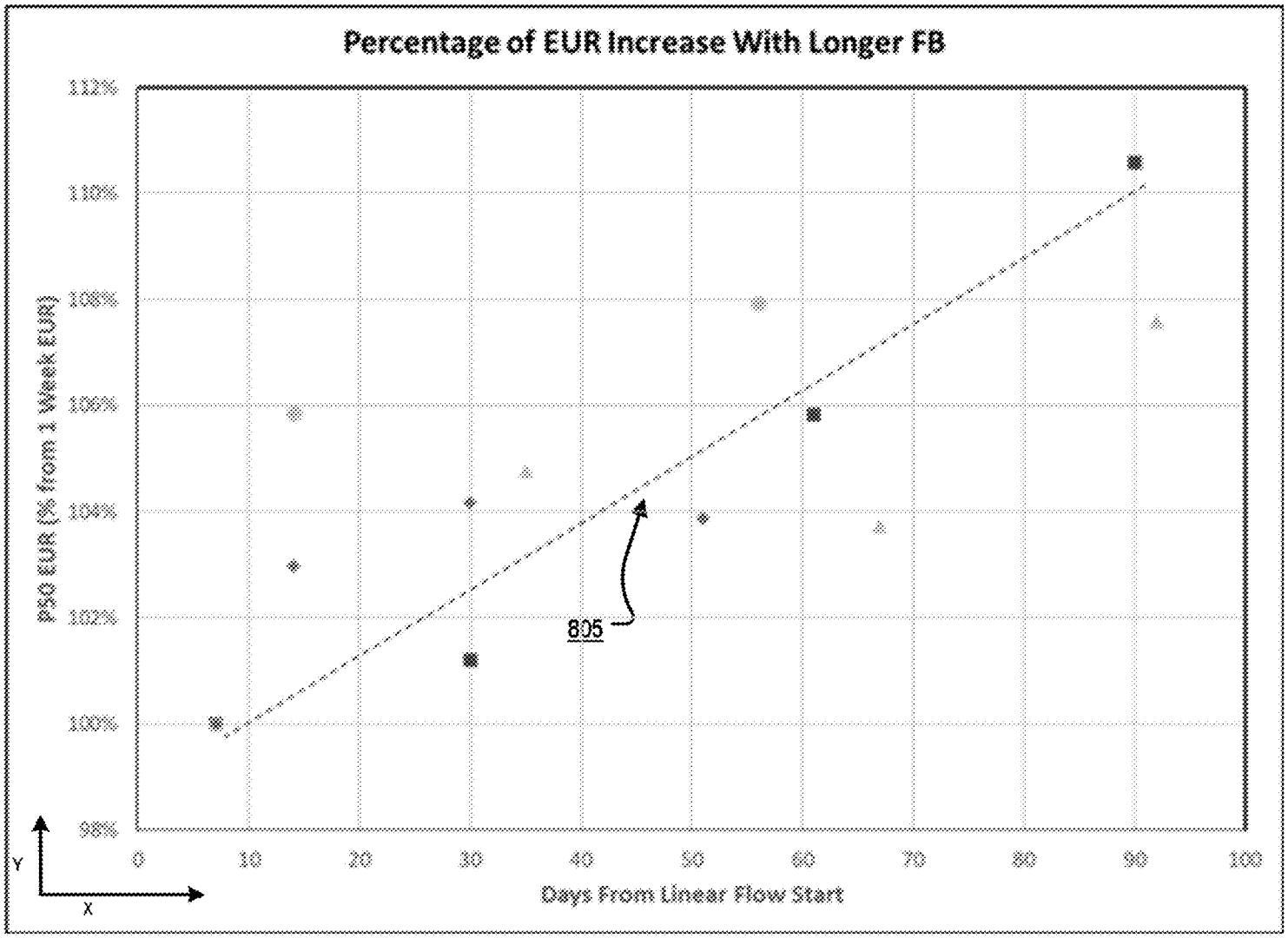
FIG. 8 depicts an example EUR forecast, in accordance with various embodiments.

FIG. 8 depicts an example change in EUR forecast with flowback time 800, in accordance with various embodiments. The plot depicts an example for the change in the estimated EUR with time from the start of linear flow for four wells that have been flowed for 90 days or more. The above-described elements of technique 100 may be applied to the four wells at different times of flowback. For consistency, the reference time to be used may be the start of linear flow for each of the wells. This reference may be desirable, because this time indicates the beginning of a known reservoir behavior. For unitization, EUR estimates at different times are presented as a percentage of the EUR estimated after one week of linear flow.

The Y axis of FIG. 8 may represent the EUR as a percentage of the EUR estimated after one week of linear flow. The X axis may represent the number of days after the start of linear flow. In this example the first point for the four wells is the same (ie, at 7 days from linear flow EUR is 100%). In this example the maximum number of days after linear flow is 90 days, after that the EUR estimates stabilize. As may be seen at 805, at 90 days from the start of linear flow EUR increased by about 10%. For wells with short flow back data, it is likely that the well will have one to two weeks of linear flow by the end of flowback test. Accordingly, in this example, the estimated EUR from these short flowback tests may be corrected by adding extra 10% of the estimated EUR. These corrected EUR values together with EUR estimates from wells with extended production periods are then used in FIG. 9.

Figure 9:
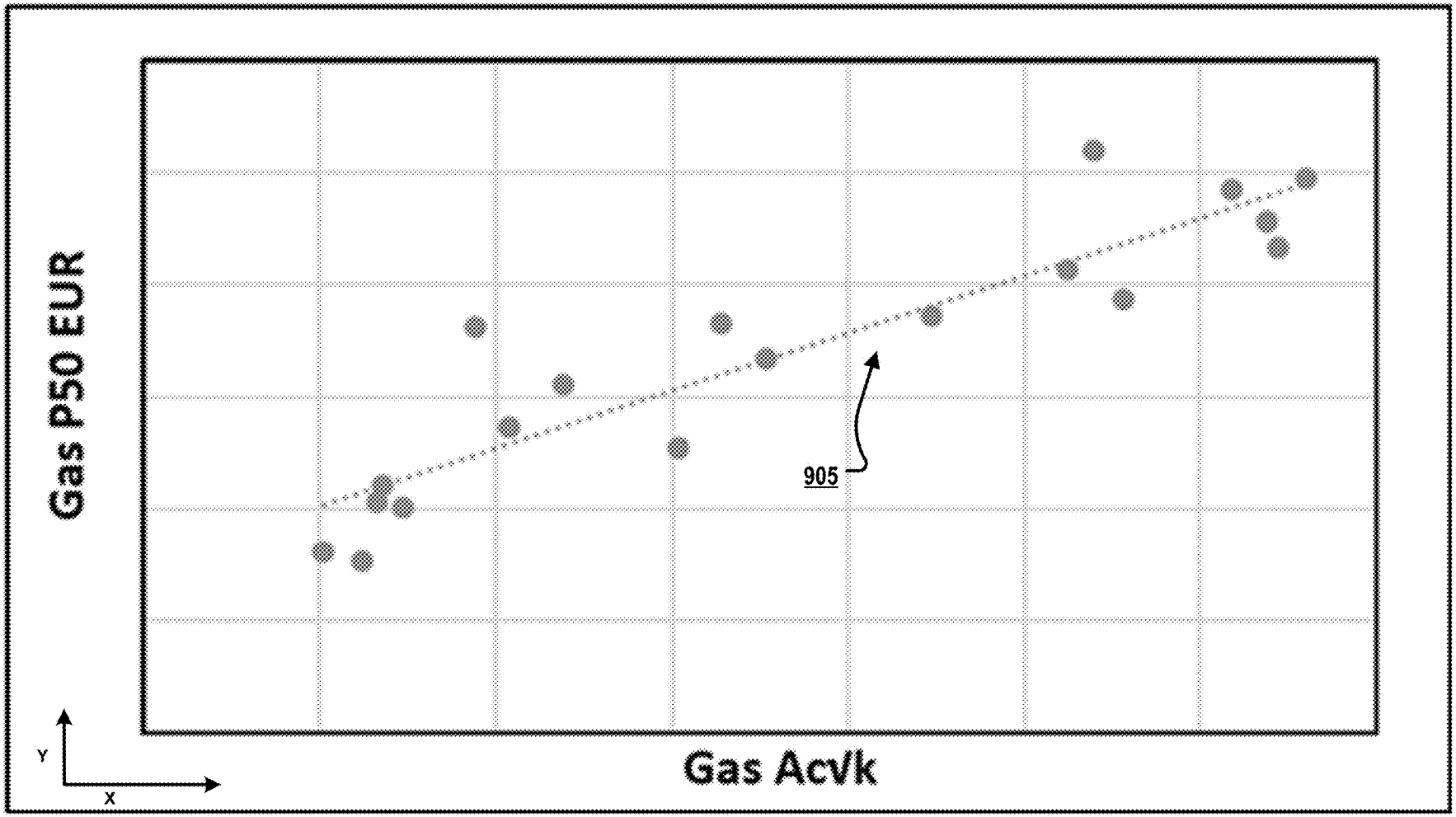
FIG. 9 depicts an example correlation of gas flow capacity with EUR, in accordance with various embodiments.

Turning to FIG. 9, FIG. 9 depicts an example 900 correlation of gas flow capacity with EUR, in accordance with various embodiments. Specifically, as a measure for productivity, it may be implicit that $Ac\sqrt{k}$ is correlated to EUR. The example 900 depicts such a correlation, where the Y axis depicts EUR while the X axis depicts gas flow capacity $Ac\sqrt{k}$. As may be seen, line 905 depicts best fit obtained through linear regression at 110. In embodiments, this straight-line relationship may be used to evaluate new wells, provided that linear flow of that well has been established. Generally, such evaluation may occur at between four and six weeks of gas flowback. However, it will be noted that in other embodiments the evaluation may occur sooner or later than that time frame depending on cleanup and flowback strategy.

Figure 10:
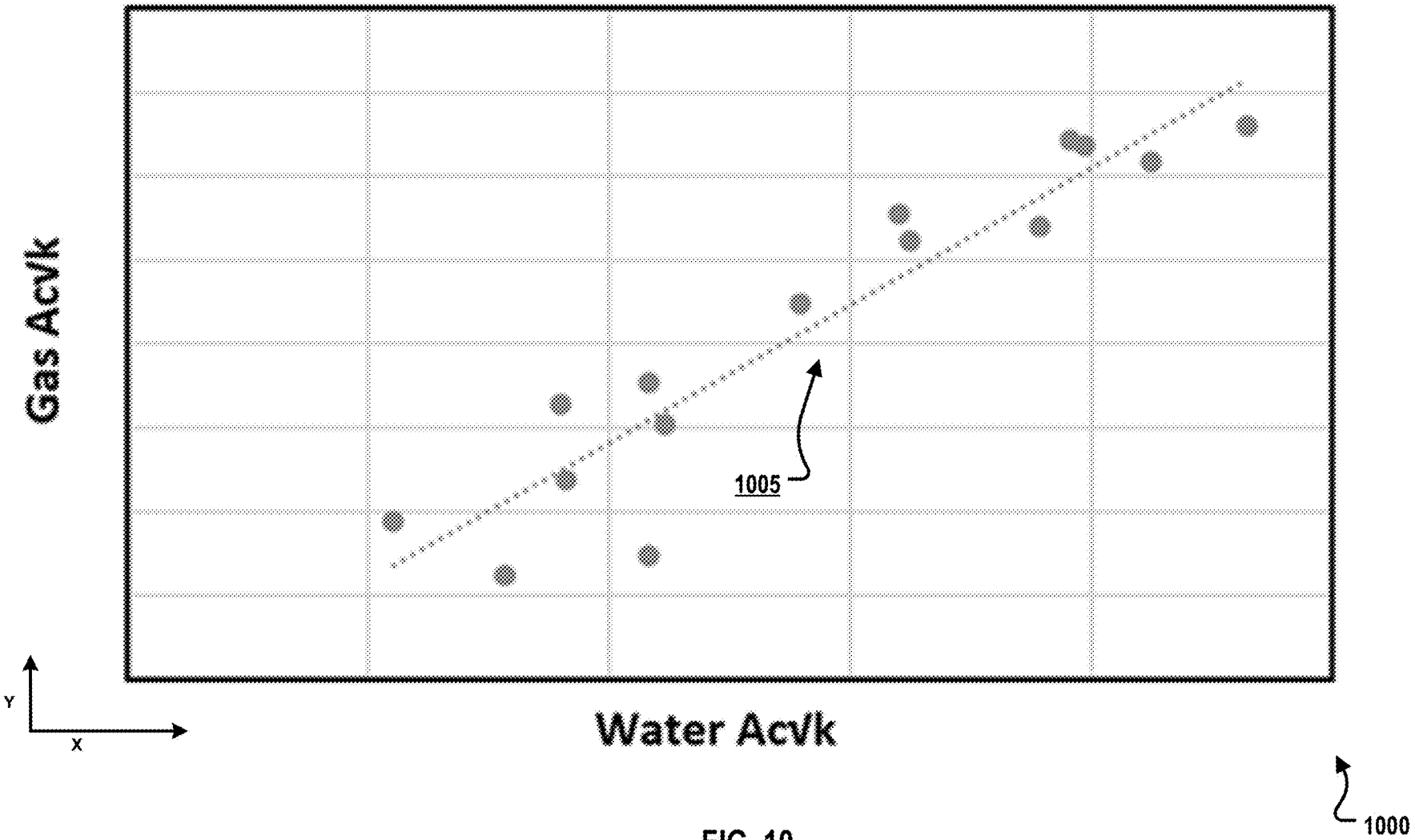
FIG. 10 depicts an example correlation of gas flow capacity to water flow capacity, in accordance with various embodiments.

The technique 100 may then include identifying, at 112, a correlation between gas flow capacity and water flow capacity. FIG. 10 depicts an example 1000 correlation of gas flow capacity to water flow capacity, in accordance with various embodiments. Water flow capacity may be identified in the first one to two weeks of well operation, for example during well cleanup to remove well completion fluid. Similar to gas flow capacity, plotting water normalized pressure against water material balance time may yield water flow capacity $Ac\sqrt{k}$. Provided that the same completion fluid is used for hydraulic fracturing in each of the analyzed wells, gas $Ac\sqrt{k}$ may be directly proportional to water $Ac\sqrt{k}$. FIG. 10 depicts a plot of gas $Ac\sqrt{k}$ on the Y axis and water $Ac\sqrt{k}$ on the X axis. As may be seen at 1005, a best fit line through linear regression relationship between the gas and water flow capacities may be identified at 112. This straight-line relationship may be used to evaluate new tested wells from water flowback during initial well cleanup.

Returning to FIG. 1, after obtaining the correlations and best fit lines through linear regression at 110 & 112 as described above, for any new well, plots similar to FIG. 2 & FIG. 3 may be created at 114, to estimate gas flow capacity of the well under analysis.

The EUR of the well under analysis may then be forecasted at 116 based on the best fit line obtained at 110 and the calculated gas flow capacity at 114. Specifically, the EUR of the well may be forecasted based on the correlation described above with respect to FIG. 9.

Figure 11:
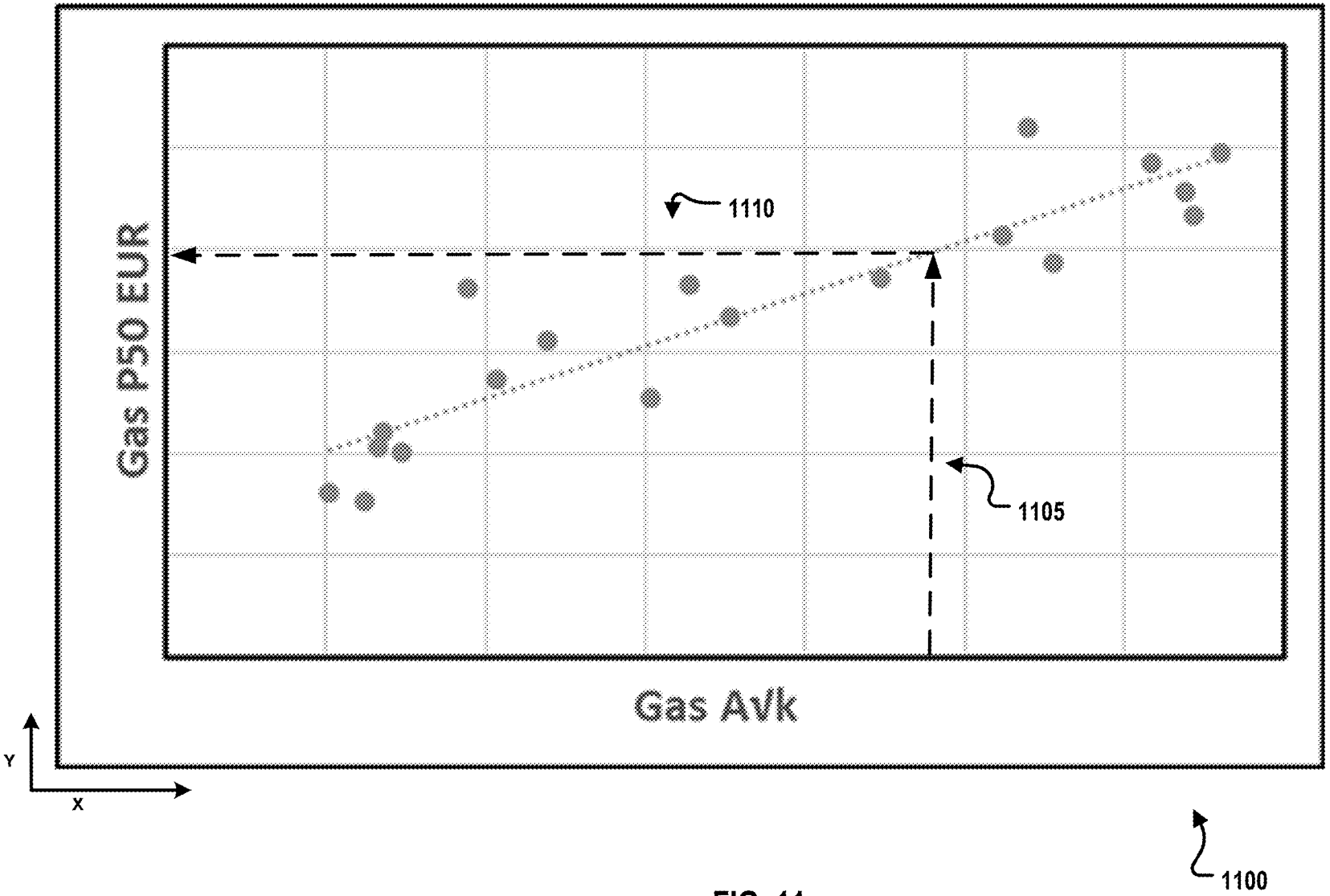
FIG. 11 depicts an example of estimating EUR for new well using its estimated gas flow capacity, in accordance with various embodiments.

FIG. 11 depicts an example 1100 of estimating EUR for new well using its estimated gas flow capacity. Such gas flow capacity may be based on, for example, between four and six weeks of gas flowback data after linear flow is established. Using the correlation described with respect to FIG. 9, line 1105 depicts the estimated gas flow capacity of the new well, going vertically from X axis until intercepts with the best fit line. Line 1110 then depicts the estimated EUR of the new well, moving horizontally, from interception point with best fit line, towards Y axis to read the EUR for the new well.

In situations where the flowback time was too short (e.g., on the order of one to two weeks) and/or the gas linear flow couldn't be established, water flow capacity may be identified and used to estimate gas flow capacity and hence EUR. Such water flow capacity may be based on, for example, between one and two weeks of water flowback data as described above.

Figure 12:
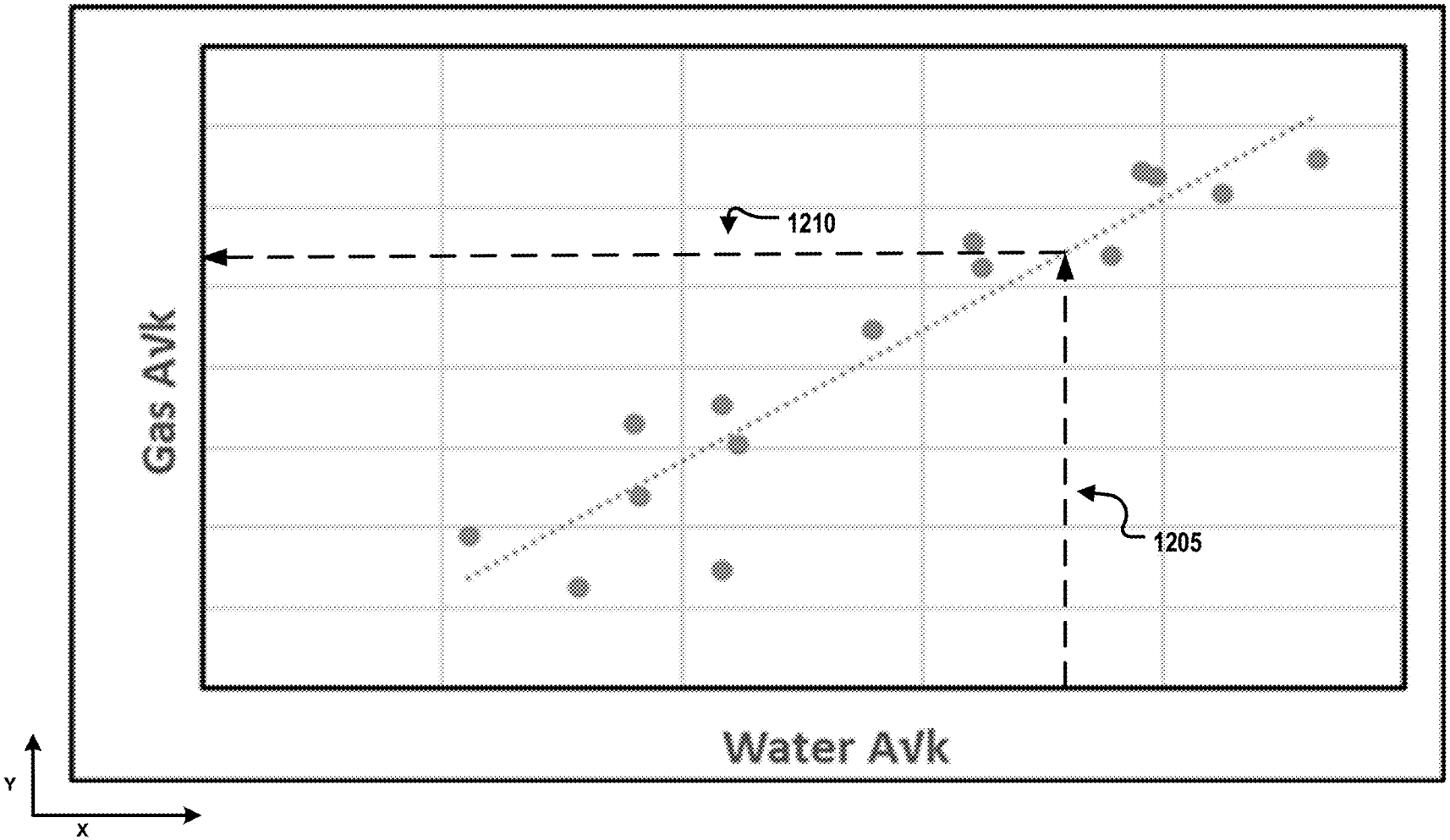
FIG. 12 depicts an example of estimating gas flow capacity for new well using its estimated water flow capacity, in accordance with various embodiments.

FIG. 12 depicts an example 1200 of estimating gas flow capacity for new well using its estimated water flow capacity. Using the correlation described with respect to FIG. 10, line 1205 depicts the estimated water flow capacity of the new well, going vertically from X axis until intercepts with the best fit line. Line 1210 then depicts the estimated gas flow capacity of the new well, moving horizontally, from interception point with best fit line, towards Y axis to read gas flow capacity for the new well. The gas flow capacity may be then used to estimate the new well EUR as shown previously in FIG. 11.

Figure 13:
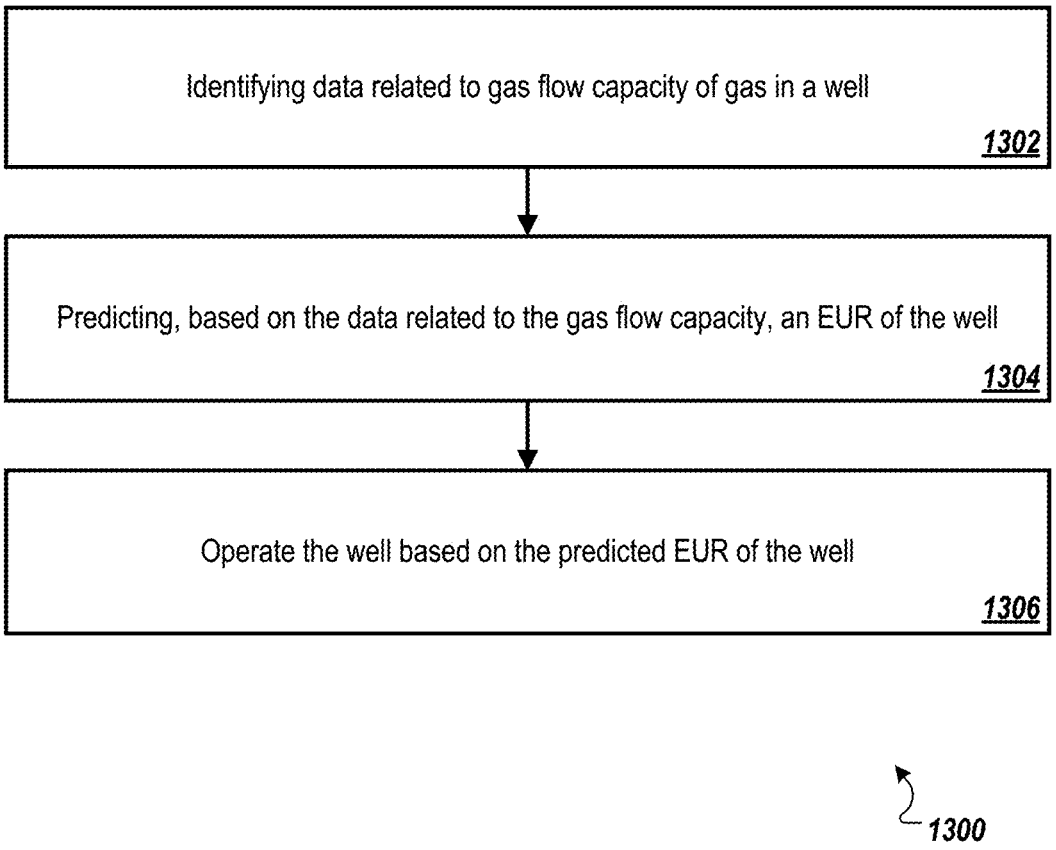
FIG. 13 depicts an example technique for prediction of EUR of a well, in accordance with various embodiments.

FIG. 13 depicts an example technique 1300 for prediction of EUR of a well, in accordance with various embodiments. The technique includes identifying, at 1302, data related to gas flow capacity of gas in a well. The data may be based on, for example, flowback data of the well as described above. In some embodiments, the flowback data may be between four and six weeks of gas flowback data of the well. In some embodiments, the gas flow capacity may be based on measurements related to water flow capacity of the well, and then correlation between the gas flow capacity and water flow capacity as described above with respect to FIG. 10.

The technique 1300 further includes predicting, at 1304 based on the data related to the gas flow capacity, an EUR of the well. Such a prediction may be based on a correlation between the gas flow capacity and the EUR of the well as described above with respect to, for example, FIG. 9.

The technique 1300 further includes, operating, at 1306, the well based on the predicted EUR of the well. In some embodiments, the operation may include updating well completion and field development plan models. In some embodiments, the operation may include modifying and/or adjusting such plan models by altering, for example, the number of development wells, the spacing between development wells, or development wells placement and fracturing job design. In some embodiments, the operation may include identifying parameters related to further use of the well, optimizing parameters related to operation of the well (e.g., fracture fluid type and volume, proppant type and amount, number of fracture clusters and stages, etc.

Figure 14:
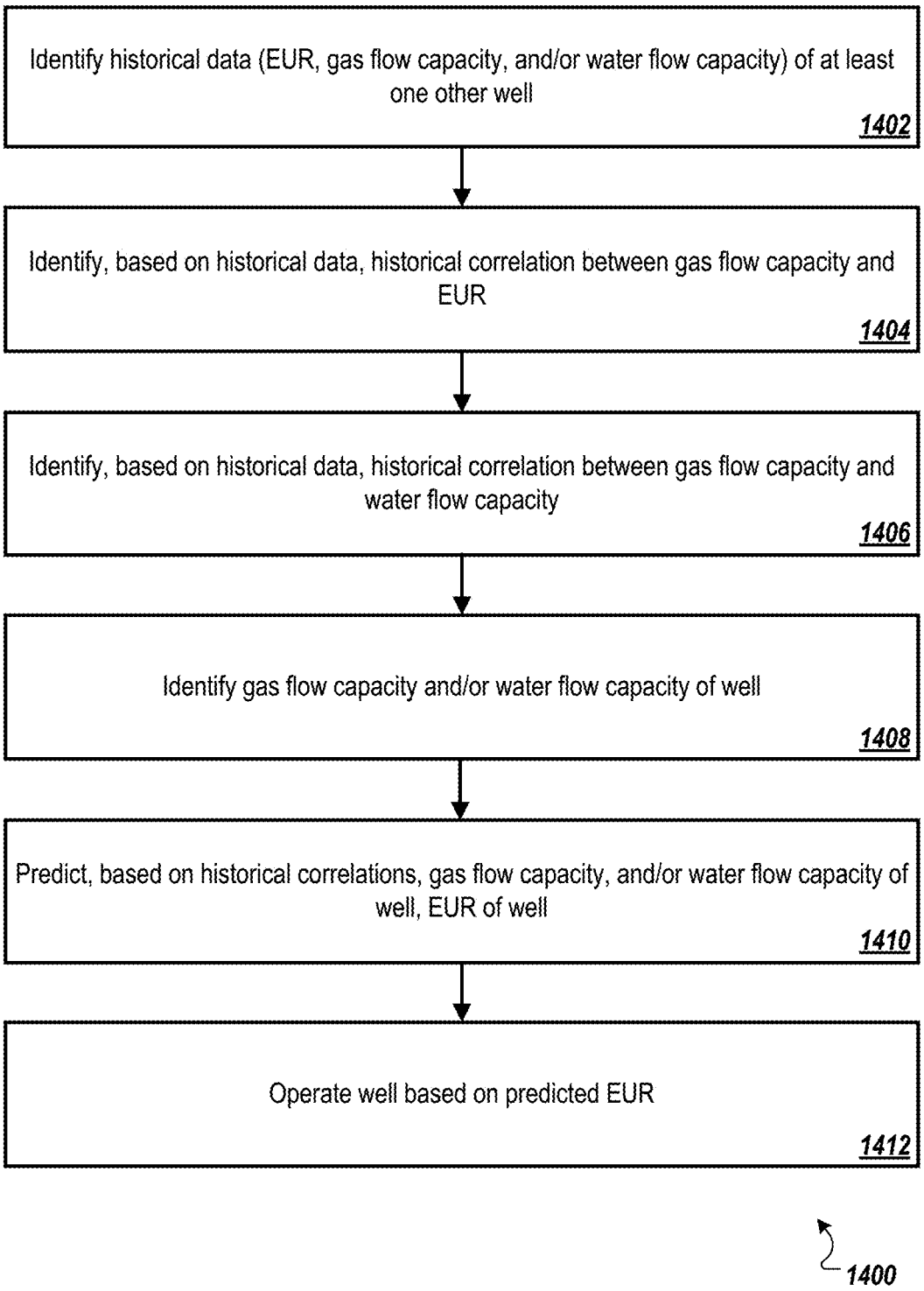
FIG. 14 depicts an alternative example technique for prediction of EUR of a well, in accordance with various embodiments.

FIG. 14 depicts an alternative example technique 1400 for prediction of EUR of a well, in accordance with various embodiments.

The technique 1400 includes identifying, at 1402, historical data of at least one other well. Such historical data may be, for example, EUR, gas flow capacity, or water flow capacity of the at least one other well. Such identification may be similar to that described above with respect to elements 102 or 104.

The technique 1400 further includes identifying, at 1404 based on the historical data, a historical correlation between gas flow capacity and EUR. Such a correlation may be similar to the correlation described above with respect to, for example, FIG. 9.

The technique 1400 further includes identifying, at 1406 based on the historical data, a historical correlation between gas flow capacity and water flow capacity. Such a correlation may be similar to the correlation described above with respect to, for example, FIG. 10.

The technique 1400 further includes identifying, at 1408, gas flow capacity or water flow capacity of the well under analysis. Such identification may be based on, for example, four to six weeks of gas flowback data or one to two weeks of water flowback data as described above.

The technique 1400 further includes predicting, at 1410 based on the historical correlations from elements 1404 or 1406 and the gas or water flow capacities from element 1408, the EUR of the well. Particularly, the EUR may be predicted by comparing the identified gas flow capacity of the well (which is either measured or based on the water flow capacity) to the correlation described with respect to FIG. 9.

The technique 1400 further includes, based on the predicted EUR, updating, at 1412, well completion strategy and field development plan and modify and adjust if necessary. This element may be similar to, for example, element 1306 described above.

It will be recognized that the above description of FIGS. 1-14 is intended as an example to provide discussion of various concepts herein. The specific variables, time frames, or numerical representations used are provided for the sake of discussion, and other embodiments may vary. For example, in some embodiments the variables used for different measurements or correlations may be different than described above. Additionally, certain measurements may be taken over longer or shorter time frames than described above, for example based on the data collected or the amount or type of historical data used.

The techniques of FIGS. 1-14 can be performed, for example, by any suitable system, environment, software, and hardware, or a combination of systems, environments, software, and hardware, as appropriate. In some implementations, various elements of the techniques of FIGS. 1-14 can be run in parallel, in combination, in loops, or in any order.

Figure 15:
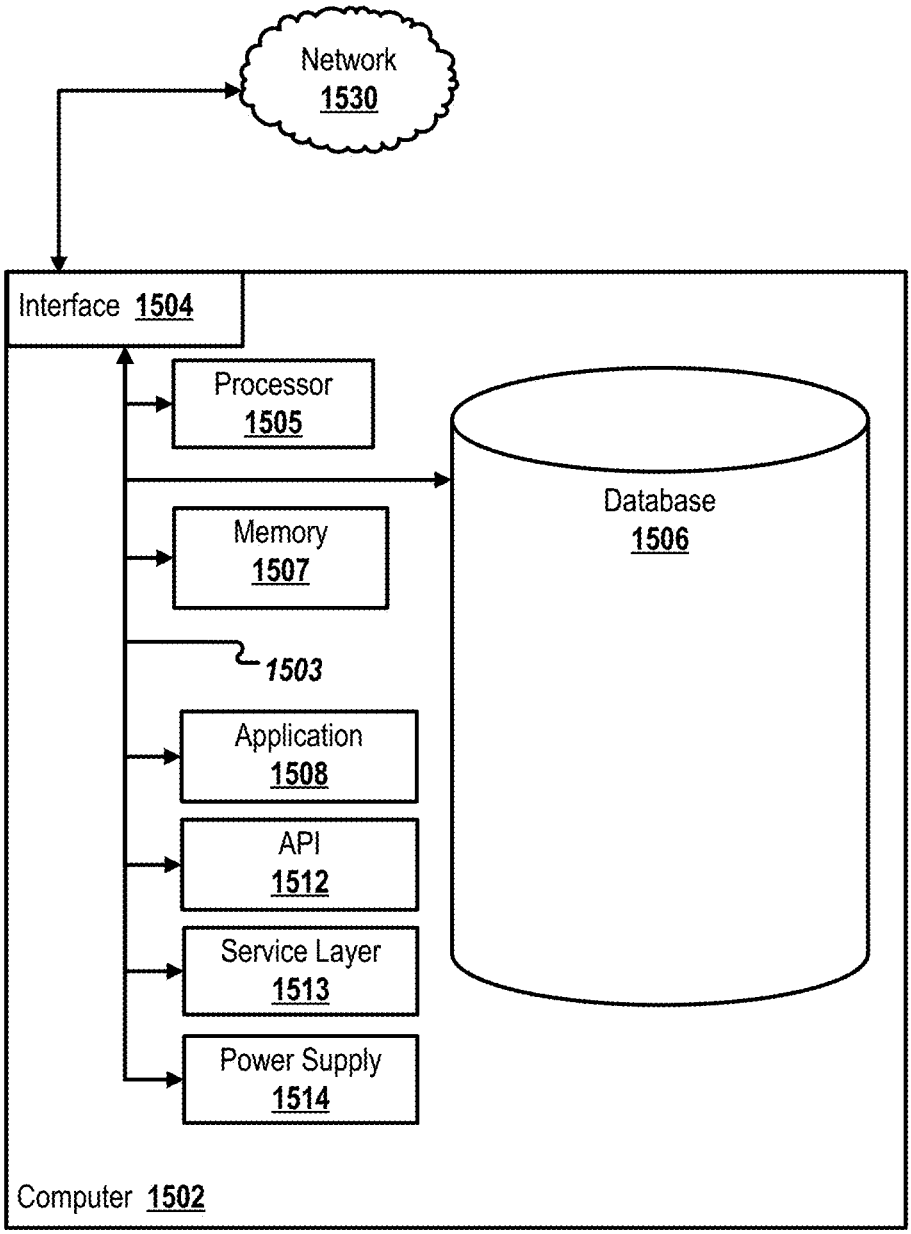
FIG. 15 is a block diagram illustrating an example computer system used to provide computational functionalities associated with described algorithms, methods, functions, processes, flows, and procedures as described in the present disclosure, in accordance with various embodiments.

FIG. 15 is a block diagram of an example computer system 1500 used to provide computational functionalities associated with described algorithms, methods, functions, processes, flows, and procedures described in the present disclosure, according to some implementations of the present disclosure. The illustrated computer 1502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1502 can include input devices such as keypads, keyboards, and touch screens that can accept user information. Also, the computer 1502 can include output devices that can convey information associated with the operation of the computer 1502. The information can include digital data, visual data, audio information, or a combination of information. The information can be presented in a graphical user interface (UI) (or GUI).

The computer 1502 can serve in a role as a client, a network component, a server, a database, a persistency, or components of a computer system for performing the subject matter described in the present disclosure. The illustrated computer 1502 is communicably coupled with a network 1530. In some implementations, one or more components of the computer 1502 can be configured to operate within different environments, including cloud-computing-based environments, local environments, global environments, and combinations of environments.

At a top level, the computer 1502 is an electronic computing device operable to receive, transmit, process, store, and manage data and information associated with the described subject matter. According to some implementations, the computer 1502 can also include, or be communicably coupled with, an application server, an email server, a web server, a caching server, a streaming data server, or a combination of servers.

The computer 1502 can receive requests over network 1530 from a client application (for example, executing on another computer 1502). The computer 1502 can respond to the received requests by processing the received requests using software applications. Requests can also be sent to the computer 1502 from internal users (for example, from a command console), external (or third) parties, automated applications, entities, individuals, systems, and computers.

Each of the components of the computer 1502 can communicate using a system bus 1503. In some implementations, any or all of the components of the computer 1502, including hardware or software components, can interface with each other or the interface 1504 (or a combination of both) over the system bus 1503. Interfaces can use an application programming interface (API) 1512, a service layer 1513, or a combination of the API 1512 and service layer 1513. The API 1512 can include specifications for routines, data structures, and object classes. The API 1512 can be either computer-language independent or dependent. The API 1512 can refer to a complete interface, a single function, or a set of APIs.

The service layer 1513 can provide software services to the computer 1502 and other components (whether illustrated or not) that are communicably coupled to the computer 1502. The functionality of the computer 1502 can be accessible for all service consumers using this service layer. Software services, such as those provided by the service layer 1513, can provide reusable, defined functionalities through a defined interface. For example, the interface can be software written in JAVA, C++, or a language providing data in extensible markup language (XML) format. While illustrated as an integrated component of the computer 1502, in alternative implementations, the API 1512 or the service layer 1513 can be stand-alone components in relation to other components of the computer 1502 and other components communicably coupled to the computer 1502. Moreover, any or all parts of the API 1512 or the service layer 1513 can be implemented as child or sub-modules of another software module, enterprise application, or hardware module without departing from the scope of the present disclosure.

The computer 1502 includes an interface 1504. Although illustrated as a single interface 1504 in FIG. 15, two or more interfaces 1504 can be used according to particular needs, desires, or particular implementations of the computer 1502 and the described functionality. The interface 1504 can be used by the computer 1502 for communicating with other systems that are connected to the network 1530 (whether illustrated or not) in a distributed environment. Generally, the interface 1504 can include, or be implemented using, logic encoded in software or hardware (or a combination of software and hardware) operable to communicate with the network 1530. More specifically, the interface 1504 can include software supporting one or more communication protocols associated with communications. As such, the network 1530 or the interface's hardware can be operable to communicate physical signals within and outside of the illustrated computer 1502.

The computer 1502 includes a processor 1505. Although illustrated as a single processor 1505 in FIG. 15, two or more processors 1505 can be used according to particular needs, desires, or particular implementations of the computer 1502 and the described functionality. Generally, the processor 1505 can execute instructions and can manipulate data to perform the operations of the computer 1502, including operations using algorithms, methods, functions, processes, flows, and procedures as described in the present disclosure.

The computer 1502 also includes a database 1506 that can hold data for the computer 1502 and other components connected to the network 1530 (whether illustrated or not). For example, database 1506 can be an in-memory, conventional, or a database storing data consistent with the present disclosure. In some implementations, database 1506 can be a combination of two or more different database types (for example, hybrid in-memory and conventional databases) according to particular needs, desires, or particular implementations of the computer 1502 and the described functionality. Although illustrated as a single database 1506 in FIG. 15, two or more databases (of the same, different, or combination of types) can be used according to particular needs, desires, or particular implementations of the computer 1502 and the described functionality. While database 1506 is illustrated as an internal component of the computer 1502, in alternative implementations, database 1506 can be external to the computer 1502.

The computer 1502 also includes a memory 1507 that can hold data for the computer 1502 or a combination of components connected to the network 1530 (whether illustrated or not). Memory 1507 can store any data consistent with the present disclosure. In some implementations, memory 1507 can be a combination of two or more different types of memory (for example, a combination of semiconductor and magnetic storage) according to particular needs, desires, or particular implementations of the computer 1502 and the described functionality. Although illustrated as a single memory 1507 in FIG. 15, two or more memories 1507 (of the same, different, or combination of types) can be used according to particular needs, desires, or particular implementations of the computer 1502 and the described functionality. While memory 1507 is illustrated as an internal component of the computer 1502, in alternative implementations, memory 1507 can be external to the computer 1502.

The application 1508 can be an algorithmic software engine providing functionality according to particular needs, desires, or particular implementations of the computer 1502 and the described functionality. For example, application 1508 can serve as one or more components, modules, or applications. Further, although illustrated as a single application 1508, the application 1508 can be implemented as multiple applications 1508 on the computer 1502. In addition, although illustrated as internal to the computer 1502, in alternative implementations, the application 1508 can be external to the computer 1502.

The computer 1502 can also include a power supply 1514. The power supply 1514 can include a rechargeable or non-rechargeable battery that can be configured to be either user-or non-user-replaceable. In some implementations, the power supply 1514 can include power-conversion and management circuits, including recharging, standby, and power management functionalities. In some implementations, the power supply 1514 can include a power plug to allow the computer 1502 to be plugged into a wall socket or a power source to, for example, power the computer 1502 or recharge a rechargeable battery.

There can be any number of computers 1502 associated with, or external to, a computer system containing computer 1502, with each computer 1502 communicating over network 1530. Further, the terms "client," "user," and other appropriate terminology can be used interchangeably, as appropriate, without departing from the scope of the present disclosure. Moreover, the present disclosure contemplates that many users can use one computer 1502 and one user can use multiple computers 1502.

Described implementations of the subject matter can include one or more features, alone or in combination.

For example, in a first implementation, a computer-implemented method includes: identifying, by at least one processor, historical data related to at least one remote well; identifying, by the at least one processor based on the historical data, a correlation between gas flow capacity and estimated ultimate recovery (EUR) of the at least one other well; identifying, by the at least one processor, gas flow capacity of a well; predicting, by the at least one processor based on the gas flow capacity of the well and the identified correlation between gas flow capacity and EUR of the at least one other well, EUR of the well; and operating, by the at least one processor, the well based on the predicted EUR.

The foregoing and other described implementations can each, optionally, include one or more of the following features:

A first feature, combinable with any of the following features, wherein the historical data includes at least one of: historical EUR data of the at least one remote well, historical gas flow capacity data of the at least one remote well, and historical water flow capacity of the at least one remote well.

A second feature, combinable with any of the previous or following features, wherein the historical data is historical data related to a plurality of remote wells.

A third feature, combinable with any of the previous or following features, wherein the method further includes identifying, by the at least one processor based on the historical data, a correlation between gas flow capacity and water flow capacity of the at least one other well.

A fourth feature, combinable with any of the previous features, wherein the method further includes predicting, by the at least one processor, the EUR of the well based on the correlation between gas flow capacity and water flow capacity of the at least one other well.

In another implementation, one or more non-transitory computer-readable media include instructions that, upon execution of the instructions by at least one processor of an electronic device, are to cause the electronic device to: identify historical data related to at least one remote well; identify, based on the historical data, a correlation between gas flow capacity and estimated ultimate recovery (EUR) of the at least one other well; identify gas flow capacity of a well; predict, based on the gas flow capacity of the well and the well and the identified correlation between gas flow capacity and EUR of the at least one other well, EUR of the well; and operate the well based on the predicted EUR.

The foregoing and other described implementations can each, optionally, include one or more of the following features:

A first feature, combinable with any of the following features, wherein the historical data includes at least one of: historical EUR data of the at least one remote well, historical gas flow capacity data of the at least one remote well, and historical water flow capacity of the at least one remote well.

A second feature, combinable with any of the previous or following features, wherein the historical data is historical data related to a plurality of remote wells.

A third feature, combinable with any of the previous or following features, wherein the instructions are further to identify, based on the historical data, a correlation between gas flow capacity and water flow capacity of the at least one other well.

A fourth feature, combinable with any of the previous features, wherein the instructions are further to predict the EUR of the well based on the correlation between gas flow capacity and water flow capacity of the at least one other well.

In another implementation, a computer-implemented method includes: identifying, by at least one processor of an electronic device, data related to gas flow capacity of gas in a well; predicting, by the at least one processor based on the data related to the gas flow capacity, an estimated ultimate recovery (EUR) of the well; and operating, by the at least one processor, the well based on the predicted EUR of the well.

The foregoing and other described implementations can each, optionally, include one or more of the following features:

A first feature, combinable with any of the following features, wherein the method further includes predicting, by the at least one processor, the EUR of the well based on a correlation of historical gas flow capacity data of at least one other well and a historical EUR of the at least one other well.

A second feature, combinable with any of the previous or following features, wherein the data related to the gas flow capacity of the well is based on less than five weeks of gas flowback data of the well.

A third feature, combinable with any of the previous or following features, wherein the gas flowback data is related to fluid recovery during operation of the well.

A fourth feature, combinable with any of the previous or following features, wherein the gas flow capacity is related to area of flow of the gas within the well multiplied by the square root of a gas permeability value of the gas.

A fifth feature, combinable with any of the previous or following features, wherein the method further includes estimating, by the at least one processor, the gas flow capacity of the well based on a water flow capacity of water in the well.

A sixth feature, combinable with any of the previous or following features, wherein the method further includes estimating the gas flow capacity of the well based on a correlation of historical gas flow capacity of at least one other well and historical water flow capacity of the at least one other well.

A seventh feature, combinable with any of the previous or following features, wherein the correlation is a linear correlation.

An eighth feature, combinable with any of the previous or following features, wherein the water flow capacity of the well is based on less than three weeks of water flowback data of the well.

A ninth feature, combinable with any of the previous features, wherein the water flow capacity is related to area of water flow of the water within the well multiplied by the square root of a water permeability value of the water.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware-or software-based (or a combination of both hardware-and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of UI elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A method comprising:

identifying, by at least one processor, historical data related to at least one remote well;

identifying, by the at least one processor based on the historical data, a correlation between gas flow capacity and estimated ultimate recovery (EUR) of the at least one remote well;

identifying, by the at least one processor, gas flow capacity of a well;

predicting, by the at least one processor, based on the gas flow capacity of the well, the identified correlation between the gas flow capacity and EUR of the at least one remote well, and fracture parameters, an EUR of the well, wherein the fracture parameters are iteratively varied to predict the EUR; and operating, by the at least one processor, the well based on the predicted EUR.

2. The method of claim 1, wherein the historical data includes at least one of: historical EUR data of the at least one remote well, historical gas flow capacity data of the at least one remote well, and historical water flow capacity of the at least one remote well.

3. The method of claim 1, wherein the historical data is historical data related to a plurality of remote wells.

4. The method of claim 1, wherein the method further comprises identifying, by the at least one processor based on the historical data, a correlation between gas flow capacity and water flow capacity of the at least one remote well.

5. The method of claim 4, wherein the method further comprises predicting, by the at least one processor, the EUR of the well based on the correlation between gas flow capacity and water flow capacity of the at least one remote well.

6. A method comprising:

identifying, by at least one processor, data related to gas flow capacity of gas in a well during early flowback prior to connection to a production facility;

predicting, by the at least one processor based on the data related to the gas flow capacity, an estimated ultimate recovery (EUR) of the well, wherein the fracture parameters are iteratively varied to predict the EUR; and operating, by the at least one processor, the well based on the predicted EUR of the well.

7. The method of claim 6, wherein the method further comprises predicting, by the at least one processor, the EUR of the well based on a correlation of historical gas flow capacity data of at least one other well and a historical EUR of the at least one other well.

8. The method of claim 6, wherein the data related to the gas flow capacity of the well is based on less than five weeks of gas flowback data of the well.

9. The method of claim 8, wherein the gas flowback data is related to fluid recovery during operation of the well.

10. The method of claim 6, wherein the gas flow capacity is related to area of flow of the gas within the well multiplied by the square root of a gas permeability value of the gas.

11. The method of claim 6, wherein the method further comprises estimating, by the at least one processor, the gas flow capacity of the well based on a water flow capacity of water in the well.

12. The method of claim 11, wherein the method further comprises estimating the gas flow capacity of the well based on a correlation of historical gas flow capacity of at least one other well and historical water flow capacity of the at least one other well.

13. The method of claim 12, wherein the correlation is a linear correlation.

14. The method of claim 6, wherein the water flow capacity of the well is based on less than three weeks of water flowback data of the well.

15. The method of claim 6, wherein the water flow capacity is related to area of water flow of the water within the well multiplied by the square root of a water permeability value of the water.

* * * * *